US007381083B2

(12) United States Patent
Amidon

(10) Patent No.: US 7,381,083 B2
(45) Date of Patent: Jun. 3, 2008

(54) ETHERNET CONNECTOR APPARATUS AND METHOD

(75) Inventor: Jeremy Amidon, Marcellus, NY (US)

(73) Assignee: John Mezzalingua Associates, Inc., E. Syracuse, NY (US)

( * ) Notice: Subject to any disclaimer, the term of this patent is extended or adjusted under 35 U.S.C. 154(b) by 0 days.

(21) Appl. No.: 11/457,974

(22) Filed: Sep. 13, 2006

(65) Prior Publication Data

US 2008/0064251 A1 Mar. 13, 2008

(51) Int. Cl.
*H01R 4/24* (2006.01)

(52) U.S. Cl. ..... 439/418

(58) Field of Classification Search ..... 439/418
See application file for complete search history.

(56) References Cited

U.S. PATENT DOCUMENTS 2,724,810 A 11/1955 Keeler et al.
5,304,074 A 4/1994 Andre et al.
5,957,720 A 9/1999 Boudin
6,746,255 B1 6/2004 Lee et al.
6,866,538 B2 3/2005 Lee
6,890,210 B2 5/2005 Lee
2002/0039856 A1* 4/2002 Huang ..... 439/418
2002/0098733 A1 7/2002 Okamura et al.

* cited by examiner

*Primary Examiner*—Gary F. Paumen
(74) *Attorney, Agent, or Firm*—Schmeiser, Olsen & Watts

(57) ABSTRACT

Provided is an ethernet connector comprising a housing having an insulation displacement contact securely disposed within a hollow portion of the housing, and an insertion member, having a hole configured to receive a wire in a manner so that the wire extends through the hole in a direction perpendicular to an operable direction of insertion of the cartridge into the housing and so that the wire makes electrical connection with the insulation displacement contact when the cartridge is inserted into the cavity. Methodology for forming an ethernet connector is also provided.

20 Claims, 8 Drawing Sheets

ETHERNET CONNECTOR APPARATUS AND METHOD

FIELD OF THE INVENTION

The present invention pertains generally to the field of electrical connectors for transmission of data between sources. More particularly the present invention pertains to an improved ethernet connector apparatus and method.

BACKGROUND

Communication cables and in particular data cables used for the transmission of information according to the ethernet standard are commonplace and used in a multitude of environments. A type of cable connector being used with increasing frequency is generally referred to as RJ-45 connector, RJ stands for registered jack. Commonly used cables often include twisted wire pairs to minimize interference or cross-talk between the individual wires in the cable. To help prevent unwanted interference in the wires, the length of untwisted wires before entering the connector should be kept to a minimum. Typically, when fabricating a common connector, short untwisted wire lengths are inserted into and fed through channels running a length of the connector before making contact with insulation displacement contacts (IDC's). The untwisted portions of the wires are open to unwanted interference. Moreover, it is desirable to provide a good electrical connection between the wires and the IDC's. However, because the untwisted wires commonly run in a lengthwise direction in a common connector and because of the common placement of IDC's bad electrical connections with the wires are a common problem when forming a connector. Thus there is a need for an improved ethernet connector apparatus and method.

SUMMARY OF THE INVENTION

A first aspect of the present invention provides a registered jack connector apparatus comprising: a housing having a first end and a second end, the first end including at least one insulation displacement contact securely located proximate a rear portion of a cavity formed within the housing, wherein the cavity opens at the second end of the housing; and a cartridge member, insertable within the cavity of the housing, wherein the cartridge member includes a first end having at least one hole, said hole configured to receive a wire in a manner so that the wire extends through the hole in a direction perpendicular to an operable direction of insertion of the cartridge into the housing and so that the wire makes electrical connection with the insulation displacement contact when the cartridge is inserted into the cavity.

A second aspect of the present invention provides an ethernet connector comprising: a housing having an insulation displacement contact securely disposed within a hollow portion of the housing; and an insertion member, having a hole positioned so that a wire inserted through and extending out of the hole will lay into a recessed groove formed on an exterior surface of the insertion member and wherein the inserted wire makes electrical contact with the insulation displacement contact when the insertion member is compressed into the hollow portion of the housing.

A third aspect of the present invention provides a registered jack connector comprising: an outer member, having at least two insulation displacement contacts firmly located proximate a back portion of a receiving chamber; and an inner member, insertable with the receiving chamber, wherein the inner member includes means of tightly retaining wires from a twisted wire pair so that the twisted wire pair is located proximate the back portion of the receiving chamber when the wires from the twisted wire pair electrically mate with the at least two insulation displacement contacts when the inner member is inserted into the receiving chamber.

A fourth aspect of the present invention provides a method of forming an ethernet connector, said method comprising: providing an insertable cartridge having at least one hole extending vertically from a bottom portion of the cartridge to a top portion of the cartridge; inserting a wire through the hole; providing a housing having an insulation displacement contact permanently immobilized near a rear portion of a cavity extending into the housing; and inserting the cartridge into the cavity of the housing so that the wire makes an electrically operable connection with the insulation displacement contact.

BRIEF DESCRIPTION OF THE DRAWINGS

Some embodiments of this invention will be described in detail, with reference to the following figures, wherein like designations denote like members, wherein.

DETAILED DESCRIPTION OF THE INVENTION

Figure 1:
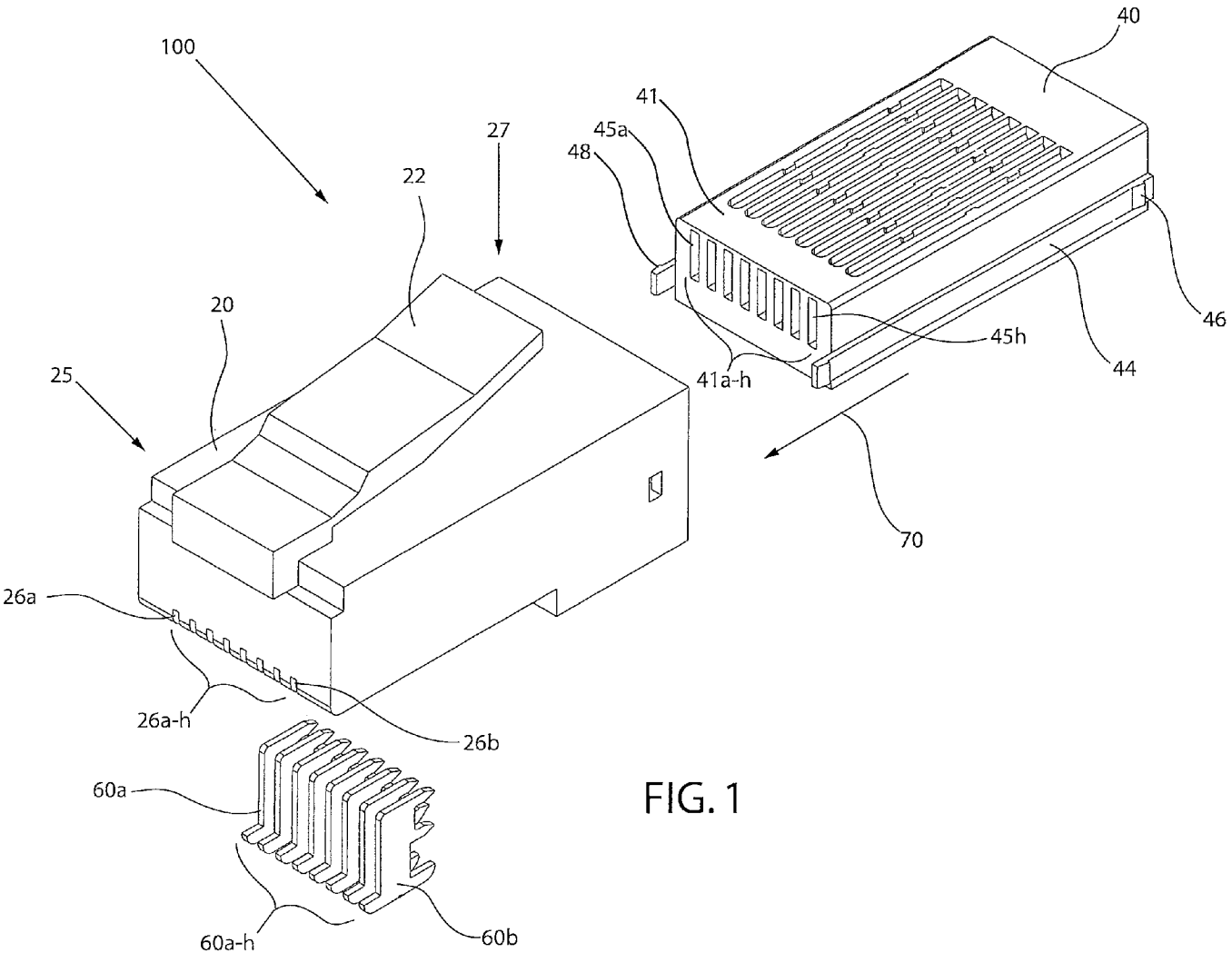
FIG. 1 shows a top front perspective view of an embodiment of a connector apparatus with IDC's exploded and exposed for viewing.

Although certain embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of an embodiment. The features and advantages of the present invention are illustrated in detail in the accompanying drawings, wherein like reference numerals refer to like elements throughout the drawings.

As a preface to the detailed description, it should be noted that, as used in this specification and the appended claims, the singular forms "a", "an" and "the" include plural referents, unless the context clearly dictates otherwise.

With reference to the drawings, FIG. 1 shows a top front perspective view of an embodiment of a connector apparatus 100 with IDC's 60 exploded and exposed for viewing, in accordance with the present invention. The connector apparatus 100 may be a registered jack type connector. For example, the connector apparatus 100 may be an RJ-45 connector that may be operable with a corresponding registered jack. Moreover, the connector 100 may be an ethernet connector facilitating the transmission of information according to the ethernet standard. The connector 100 may comprise a housing 20 that may be an outer member for receiving an insertable member such as a compression cartridge 40. The outer member housing 20 may include a locking tab 22 or other similar component operable to releasably retain the connector 100 in a jack. The locking tap may be located on a top surface of the housing 20. However, those in the art should appreciate that although the position of the locking tab 22 has been described herein in relation to a "top" surface, the connector 100 may be operable such that the locking tab 22 functionally corresponds to and interacts with a feature on the bottom of an associated jack into which the connector 100 may be inserted. Hence, when in operation, a connector 100 may be oriented in any manner that permits functional mating with a corresponding jack. In addition, the connector 100 may have a first end 25 and an opposing second end 27. Terminals 26 may be located at the first end 25 so that the connector 100 may operate with a common registered jack. For example, the connector 100 may be an RJ-45 type connector and may include eight terminals 26*a-h* configured to mate with corresponding conductive mating members of a jack configured to receive an RJ-45 type connector.

Furthermore, as shown in exploded view in FIG. 1, the connector 100 may include IDC's 60. Moreover, as shown further in FIGS. 3 and 6, the IDC's 60 may be securely located and disposed near the first end 25 and positioned internally inside the housing 20 proximate a rear or back portion of a receiving chamber or cavity 28 such as a hollow portion formed and extending within the housing 20, wherein the cavity 28 opens at the second end 27 of the housing 20. The connector 100 should include at least one IDC 60 and may include a plurality of IDC's 60*a-h*. For example, the connector may be configured to operate as an RJ-45 type connector and may include eight IDC's 60*a-h*, wherein the IDC's may electrically mate and make an electrically operable connection with wires 90*a-h* when the insertable cartridge member 40 is inserted or compressed into the receiving chamber or cavity 28 such as hollow portion of the housing 20.

Figure 2:
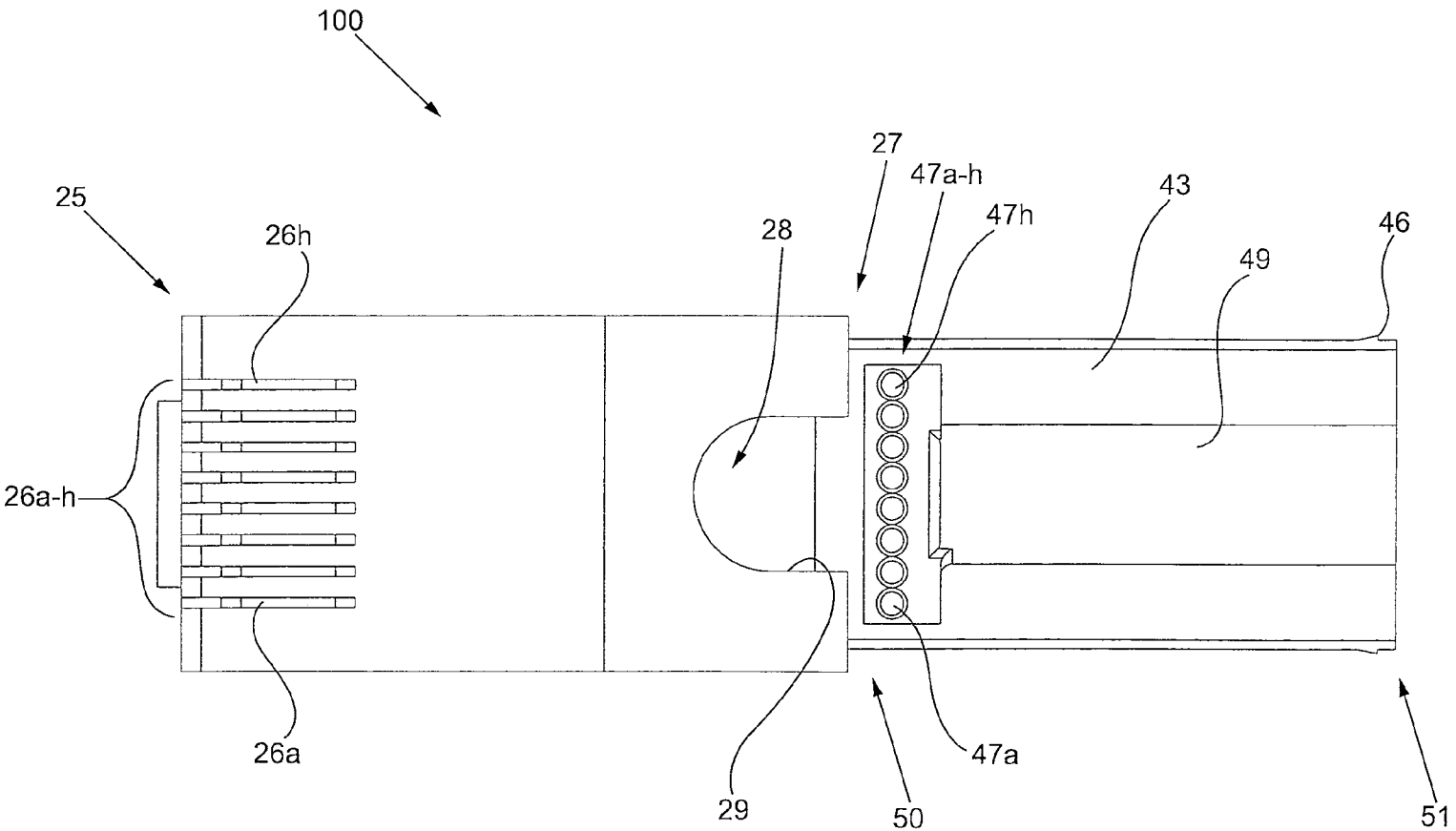
FIG. 2 illustrates a bottom view of an embodiment of a connector apparatus.
Figure 3:
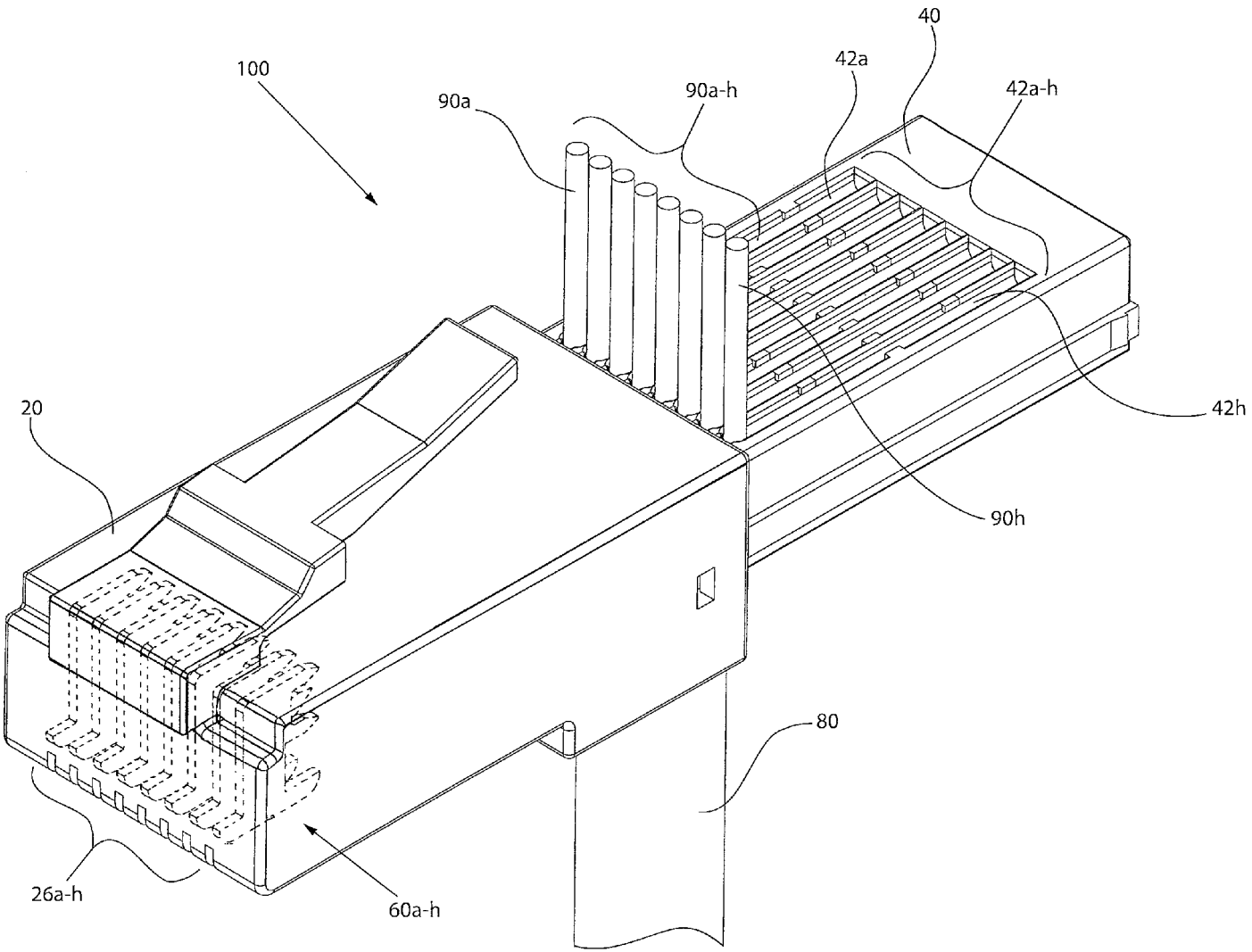
FIG. 3 illustrates a top front perspective view of an embodiment of a connector apparatus having wires initially inserted and with a portion of the connector shown in ghost lines to reveal internal placement of IDC's.

Referring further to FIG. 1 and with additional reference to FIGS. 2 and 3, a connector apparatus 100 may comprise an insertable cartridge member 40. The insertable cartridge member 40 may include a first end 50 and an opposing second end 51. In addition, the compression cartridge 40 may also include a top surface 41, as shown in FIG. 1, and a bottom surface 43, as depicted in FIG. 2. The first end 50 of the compression cartridge 40 may have at least one hole 47, said hole 47 configured to receive a wire 90 in a manner so that the wire 90 extends through the hole 47 in a direction perpendicular to the operable direction of insertion 70 of the cartridge 40 into the housing 20 and so that the wire 90 makes electrical connection with an IDC 60 when the cartridge 40 is inserted into the cavity 28. Those in the art should recognize that the compression cartridge 40 may include a plurality of holes 47*a-h*. Furthermore, a hole 47 may be positioned so that a wire 90 may be inserted therethrough and may extend out of the hole 47 and lay into a recessed groove 42, or plurality of grooves 42*a-h*, formed on an exterior surface, such as top surface 41, of the insertion cartridge member 40. Accordingly, as depicted in FIG. 3, a communications cable, such as a cable facilitating communications according to the ethernet standard, may have four sets of twisted wire pairs comprising eight individual wires 90*a-h*. The wire pairs may be partially untwisted so that wires 90*a-h* may be inserted into corresponding holes 47*a-h*. The holes may extend vertically from a bottom portion, such as a bottom surface 43, of the cartridge 40 to a top portion, such as a top surface 41, of the cartridge 40. Moreover, a hole 47 may be located at an end of a groove 42, or other surface feature that may be configured to accept and or retain a portion of a wire 90 that has been extended through the hole 47.

Referring further to FIGS. 1-3, the cartridge 40 may include surface features to help align the cartridge 40 when inserted within a cavity 28 or hollow portion of a housing 20. For example, a cartridge may include a rail member 44, protruding from or affixed to an exterior surface of the compression cartridge 40. Those in the art should recognize that the compression cartridge 40 may also include multiple rail members 44 to assist correct insertion of the compression cartridge 40. For instance there may be a rail member 44 located on each side of the insertable compression cartridge 40. The rail members 44 may interact with corresponding slots 24 formed on the side walls of hollow cavity 28 extending from the second end 27 into housing 20, and thereby may help guide or align the inner cartridge 40 member as it is inserted into the outer housing member 20.

Furthermore, a compression cartridge 40 may include additional surface features to help retain the cartridge 40 within a cavity 28 or hollow portion of a housing 20 into which the cartridge 40 is inserted. Accordingly, engagement features, such as retention shoulders 46 and/or 48, may protrude from an exterior surface(s) of the cartridge 40 or may protrude from an alignment surface feature such as a rail member 44. The engagement features, such as retention shoulders 46 and/or 48, may interact with corresponding features formed on the internal surface of the cavity 28 or hollow portion of the housing 20 to help retain the cartridge 40 once it is compressed into the hollow cavity 28 of the housing 20. It should be recognized by those of ordinary skill that the various alignment and/or retaining features of a cartridge 40 may be mirrored or configured in an inverse fashion on the interior surface of the housing 20. For example, the cavity 28 may include a rail-like protrusion that may interact with a corresponding slot formed on the insertable compression cartridge 40 in place of a rail member 44. Likewise, the hollow internal surface of the cavity 28 may also include shoulder-like protrusions that may engage and retain corresponding detents formed in place of retention shoulders 46 and/or 48.

With continued reference to FIGS. 1-3, an insertable compression cartridge 40 member may include an access feature 45 formed on a front surface of the cartridge 40. The access feature 45 may extend from the front surface to a hole 47. Moreover, a cartridge may include a plurality of access features 45*a-h* that may correspondingly extend to associated holes 47*a-h*. Therefore, a portion of each of the holes 47*a-h* may be accessed through the corresponding access features 45*a-h*. The placement of the access features 45*a-h* may also correspond to the placement of IDC's 60*a-h* proximate the rear or back surface portion of hollow cavity 28 extending into housing 20. Thus, the IDC's 60*a-h* may access holes 47*a-h* when the cartridge is compressed into the housing, such that the cartridge is moved to a position wherein the front surface of the cartridge is located proximate the rear or back portion of cavity 28. When inserted through a hole 47, or plurality of holes 47*a-h*, a wire 90 or plurality of wires 90*a-h* may be pulled firmly. For instance, twisted wire pairs of a cable, such as a cable 80, may be untwisted and then the untwisted wires, such as wires 90*a-h*, may be inserted through the holes 47*a-h* and pulled tightly so that wires 90*a-h* remain in a twisted configuration very near the entrance of the holes 47*a-h* proximate the first end 50 of the compression cartridge 40. Accordingly, when inserted, the wires 90*a-h* extending through the holes 47*a-h* may be accessed via access features 45*a-h*. Hence, the physical and electrical access location of the wires 90*a-h* may be close to the placement of the twisted pairs because the pairs may be pulled tightly against the holes 47*a-h* (as will be discussed in greater detail in relation to FIG. 6).

An outer housing 20 member may include a cable cradle 29. The cable cradle 29 may facilitate the location of a cable, such as cable 80, into a portion of the cavity 28 of the housing, wherein a lengthwise portion of the cable 80, as located in the cable cradle 29, may be oriented perpendicular to the direction of insertion 70 of the compression cartridge 40 member into the housing 20. For example, the cable cradle 29 may comprise an arch-like or semi-circle-like cut-out of the bottom surface of the housing 20. Thus, if a cable, such as cable 80, has a substantially circular diameter, then the cable 80, may remain in a perpendicular position as it inserted with a cartridge 40 when the associated wires 90*a-h* of the cable 80 are inserted through holes 47*a-h* of the cartridge 40. While, an arch-like or semi-circular-like cut out shape is depicted in relation to cable cradle 29, those in the art should recognize that any cut-out shape may be provided to correspond with an associated cable geometry or cable cross-section. Moreover, while the cut-out forming cable cradle 29 is depicted as being formed at a 90 degree angle, straight through the bottom surface of the housing 20 and extending to the cavity 28, it should also be recognized that angled cuts and/or rounded cuts may be provide as well.

Referring further to FIGS. 1-3, an insertable cartridge member 40 may include a cable channel 49, such as a rounded slot or grooved configured to accept a lengthwise portion of a cable, such as cable 80, when the cable 80 is oriented in a direction substantially parallel with the direction of insertion 70 (depicted in FIGS. 1 and 4) of the cartridge member 40. The cable channel 49 may provide and area of the connector 100 for the cable 80 to reside while inserted with the cartridge member 40. Furthermore, the cable channel 49 may be rounded or formed to match the exterior surface of a cable 80. For example, the cable channel 49 may have a semi-circular of arch-like surface (shown in FIG. 5) that may extend from the second end 51 of the insertable cartridge member 40 toward the first end 50 to location proximate the holes 47*a-h*. Hence the cable 80 may remain a unitary element at a location proximate the holes 47*a-h*, i.e., the cable 80 may remain in one unmolested piece without being stripped so that interior wires 90*a-h* are exposed and twisted wire pairs untwisted, wherein the one piece cable 80 may extend substantially the length of the cable channel 49, when the cable 80 is operable inserted with the cartridge 40 into the outer housing member 20.

Referring even further still to FIGS. 1-3, a connector 100 may include a terminal 26, or a plurality of terminals, such as terminals 26*a-h*. The terminals 26*a-h* may be located at the first end 25 of a housing 20. Moreover, the terminals 26*a-h* may be configured to contact and electrically mate with conductive elements of a registered jack. For example, if the connector 100 is an RJ-45 type connector, then the connector 100 may have eight terminals 26*a-h* that may electrically connect with conductive elements located in the back portion of an RJ-45 jack. The terminals 26*a-h* may be formed of any conductive material and may take on any shape operable to allow connection with a corresponding jack. Additionally, the terminals 26*a-h* may be compliant and may be compressed into electrical contact with various jack components. Furthermore, the terminals 26*a-h* may have a portion that is located internally within the housing 20, such that the terminals 26*a-h* make mate with, make physical contact, and/or extend an electrical connection between the terminals 26*a-h* and internally located IDC's 60*a-h*. For instance, a group of eight terminals 26*a-h* may be aligned so that the terminals 26*a-h* correspond physically and electrically with eight IDC's 60*a-h* positioned internally at the first end 25 of a housing 20 of a connector 100.

Figure 4:
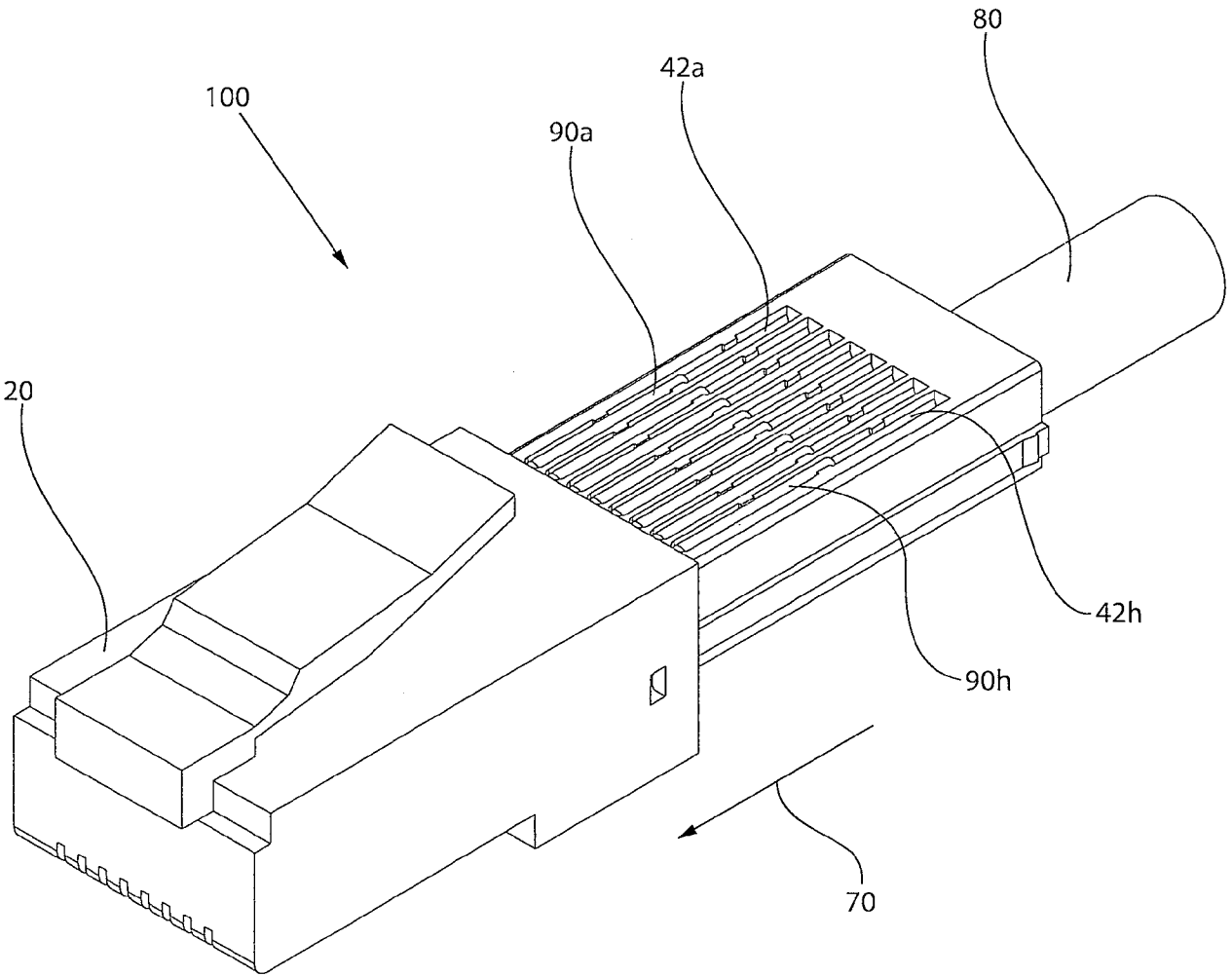
FIG. 4 illustrates a top front perspective view of an embodiment of a connector apparatus having wires initially inserted and bent down into corresponding grooves.

With continued reference to the drawings, FIG. 4 illustrates a top front perspective view of an embodiment of a connector apparatus 100 having wires 90*a-h* initially inserted and bent down into corresponding grooves 42*a-h*. For example, the wires 90*a-h* may be laid over and pushed into the grooves 42*a-h*. The grooves 42*a-h* may include protrusions or other features that may physically contact and firmly secure the wires 90*a-h* in the grooves 42*a-h* once the wires 90*a-h* have been inserted into the grooves 42*a-h*. Moreover, the cable 80 may be bent upward into the cable channel 49 (not shown) so that a portion of the cable length is aligned in parallel with the direction of insertion 70 of the cartridge member 40 into the housing 20. Thus, with the wires 90*a-h* bent into the grooves 42*a-h* and the cable 80 bent into the cable channel 49, the cartridge member 40 along with the cable 80 and wires 90*a-h* may be inserted into the housing 20 of the connector 100.

Figure 5:
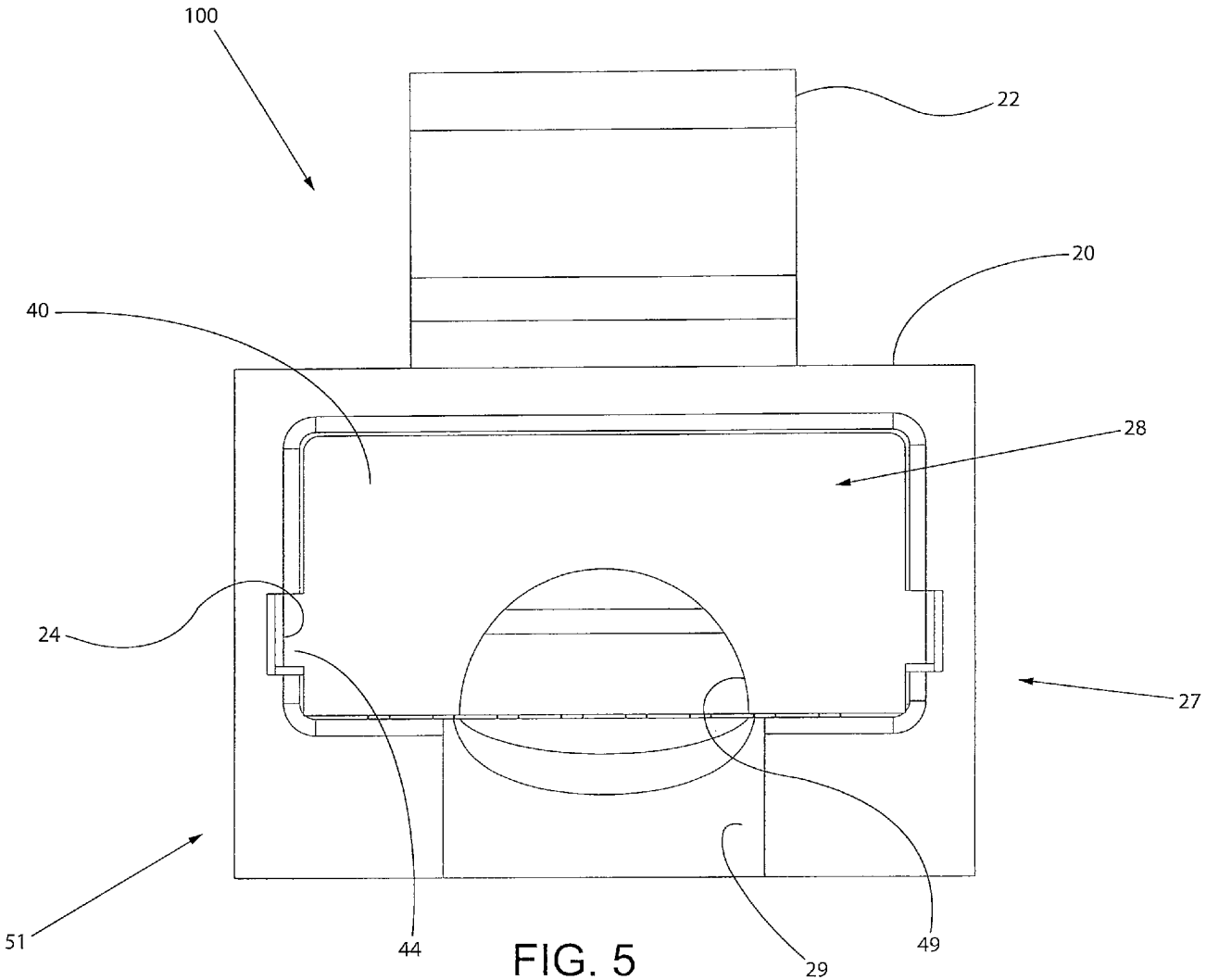
FIG. 5 illustrates a rear view of an embodiment of a connector apparatus.

Referring further to the drawings, FIG. 5 illustrates a rear view of an embodiment of a connector apparatus 100, without a cable 80 attached thereto. As illustrated in this view, a locking tab 22 may extend upward away from the housing 20. Additionally, the rails 44 of the cartridge 40 may be oriented to fit into slots 24 of the housing 20, when the cartridge 40 is inserted into the cavity 28 extending from the second end 27 of the outer housing body 20. Also depicted in this view the cable cradle 29 may be a cut out extending through the bottom surface of the housing 20. Moreover, the arch-like shape of the cable channel 49 extending from the second end 51 of the insertable cartridge member 40 is also illustrated in this view.

Figure 6:
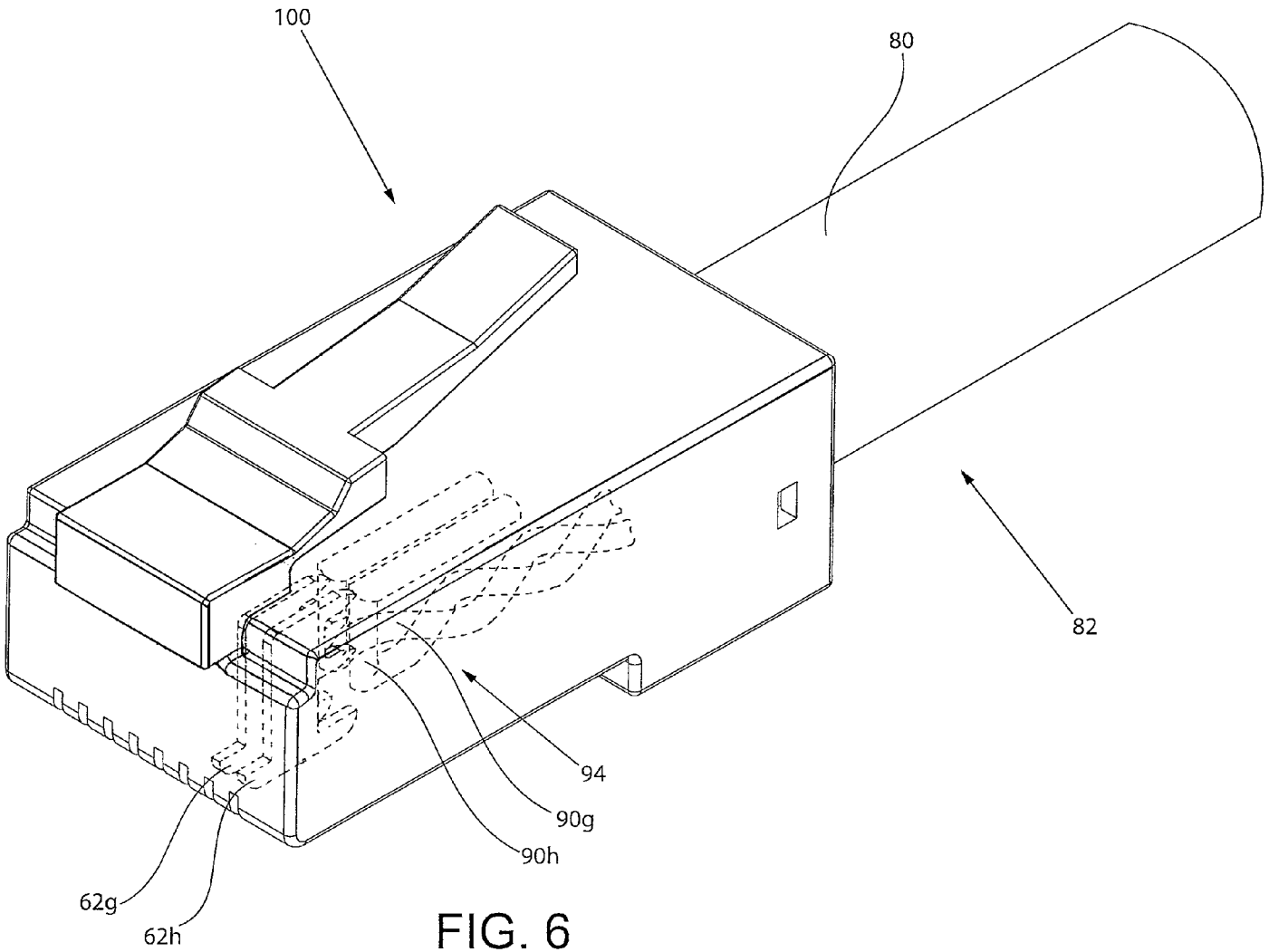
FIG. 6 illustrates a top front perspective view of an embodiment of a connector apparatus having wires fully inserted and in contact with IDC's and with a portion of the connector shown in ghost lines to reveal final internal placement of twisted wire pairs.
Figure 7:
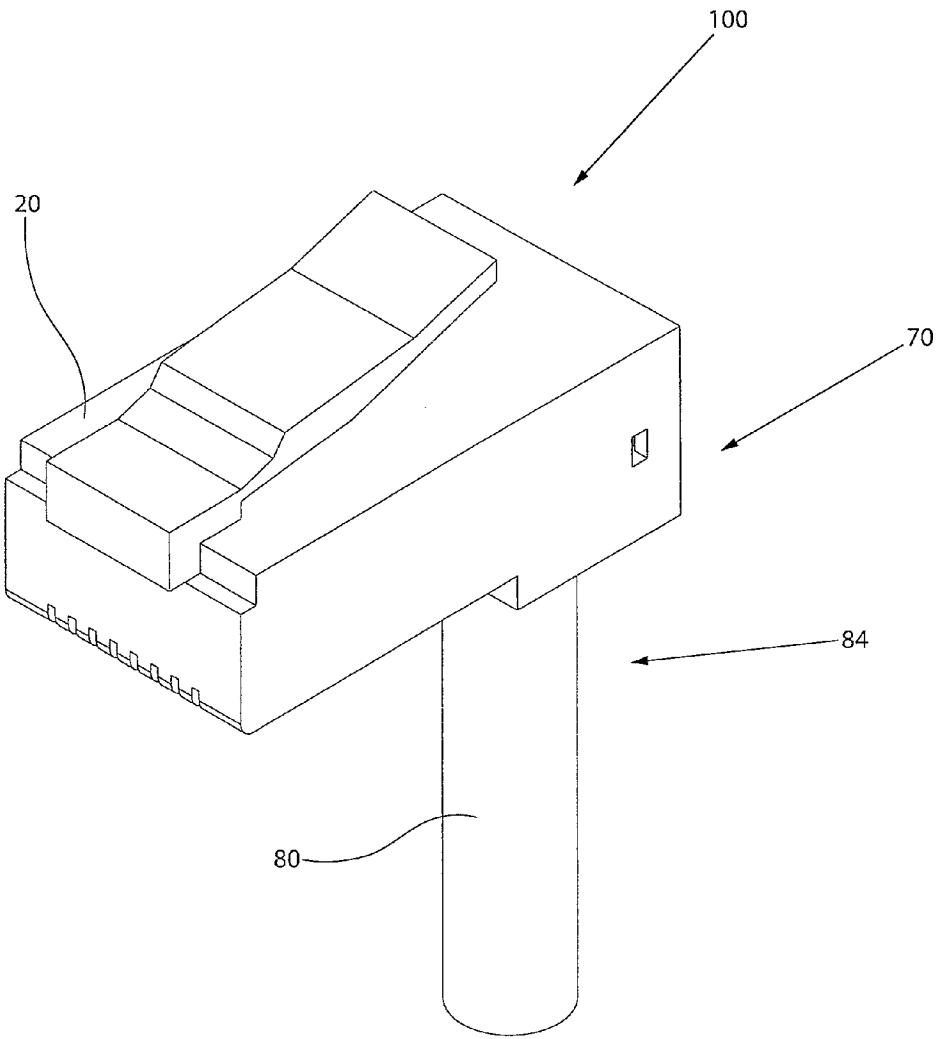
FIG. 7 shows a top front perspective view of an embodiment of connector apparatus with a cable in a perpendicular position.

With continued reference to FIGS. 1-5 and additional reference to FIG. 6, a connector apparatus 100 is illustrated with a portion of the connector 100 shown in ghost lines to reveal final internal placement of twisted wire pairs, such as a wire pair 94, having wires, such as wires 90*g* and 90*h*, fully inserted and in contact with IDC's, such as IDC's 90*a* and 90*h*. Accordingly, when a cartridge member 40, having a cable 80 operably attached with wires 90*a-h* inserted through holes 47*a-h* and bent into grooves 42*a-h*, is compressed into housing 20, portions of the IDC's 60*a-h* may make electrical contact with the wires 90*a-h*. The inner cartridge member 40 may include means of tightly retaining the wires 90*g-h* wires from a twisted wire pair 94 so that the twisted wire pair 94 is located proximate the back portion of the receiving chamber 28 when the wires 90*g-h* from the twisted wire pair 94 electrically mate with at least two IDC's when the inner cartridge member 40 is inserted into the receiving chamber 28. The means of tightly retaining the wires 90*g-h*, or 90*a-h*, may include the location of the holes

47*a-h* proximate the first end of the inner cartridge member 40 so that the wires may be pulled tightly through the holes and then compressed into wire retaining grooves 42*a-h* so that the twisted wire pairs, such as wire pair 94, may remain twisted close to the IDC's 60*a-h* when the inner cartridge member 40 is inserted into the housing 20.

Figure 8:
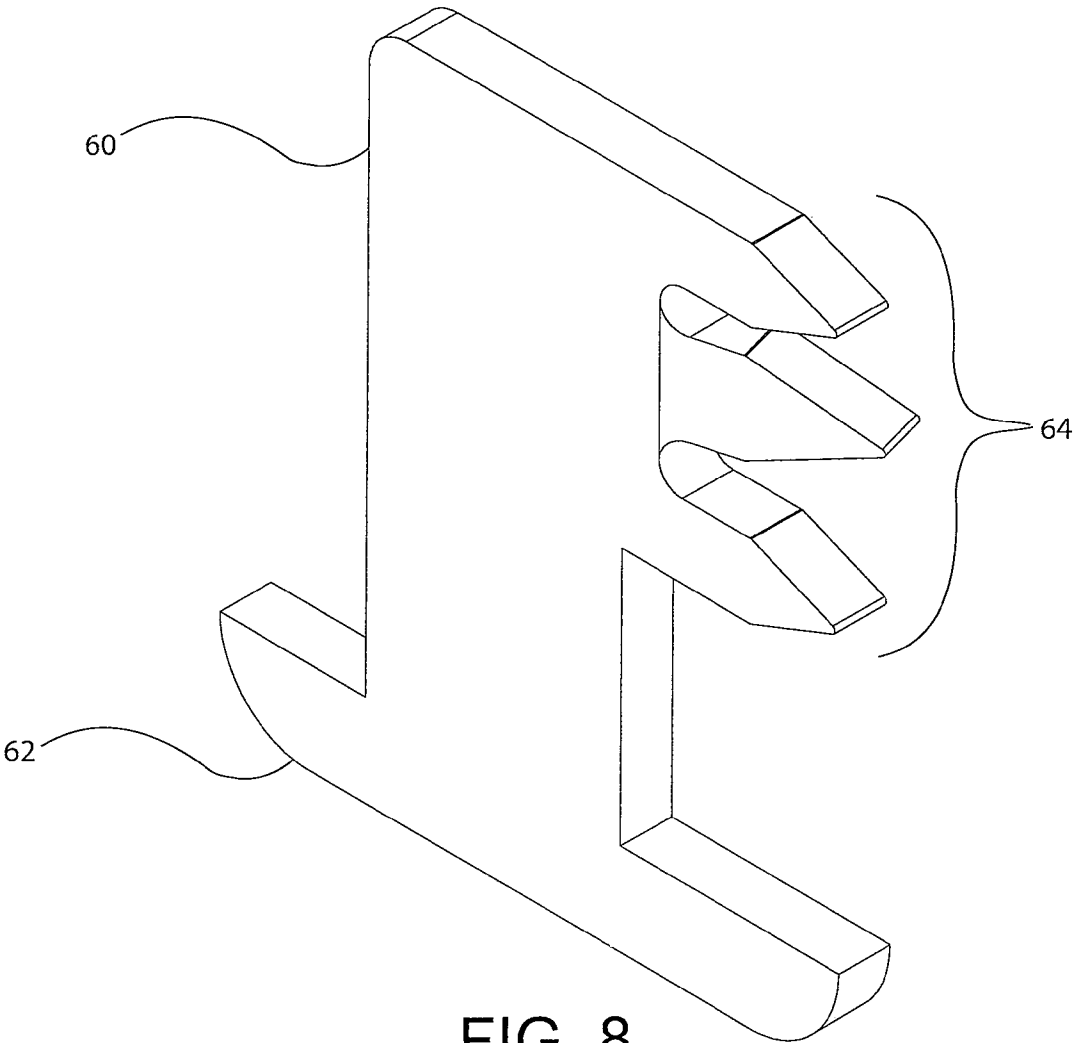
FIG. 8 shows a perspective view of an embodiment of an IDC, in accordance with the present invention.

As the inner cartridge member 40 nears the back portion of the receiving chamber 28, contact blades 64 of an IDC 60 (as particularly shown in FIG. 8) may poke or extend through a corresponding access feature 45, wherein the contact blades 64 may then make contact with a wire 90. Contact between the IDC 60 and the wire 90 may displace an insulating covering/coating or exterior insulation feature of the wire 90 and allow an electrical connection between a conductive component of the wire 90 and the a contact blade 64 of the IDC 60. Moreover, the IDC 60 may be positioned in the connector 100 so that a prong feature 62 of the IDC 60 may electrically mate and connect with a corresponding terminal 26 of the housing 20, thereby extending an electrical connection between the wire 90 and the terminal 26. Hence, the connector apparatus 100 may electrically extend an electromagnetic communication path when a conductive element of a jack or socket comes into electrical contact with a terminal 26 which may be electrically connected with an IDC 60, which may be electrically connected with a wire 90 of cable 80. Because the wire pairs, such as wire pair 94, may be located in a twisted configuration close to the IDC'S, a connector apparatus 100 may retain several advantages associated with keeping the wire pairs twisted with as little untwisting as possible, including minimization of interference or cross-talk between the individual wires 90*a-h* in the cable 80 and the simplification of cable 80 and wire 90*a-h* preparation associated with connector apparatus 100 fabrication.

Referring further to FIGS. 1-6 and 8, an insertable compression cartridge may be sized so that full insertion of the cartridge 40 into the housing 20 causes the blades of the IDC's 60*a-h* to appropriately disperse insulation of wires 90*a-h*. Moreover, the guide rails 44 working in conjunction with slots 24 may facilitate proper alignment of the IDC's 60*a-h* with the access features 45*a-h* of the cartridge 40 to effectively provide electrical engagement of the IDC's 60*a-h* with the wires 90*a-h* when the cartridge is inserted. Furthermore, the cartridge 40 may be designed so that a fit tolerance between the cartridge 40 and the hollow cavity 28 is tight enough that wires 90*a-h*, as seated in grooves 42*a-h* or simply laid flat against the cartridge 40, are not free to move, thereby keeping the wires in place and helping to alleviate potential stress on the wires 90*a-h* when the cable 80 is tugged, pulled and/or in any other way moved. When inserted into the housing 20, a portion of cable 80 may be positioned in parallel 82, with the direction of insertion of the cartridge 40. Parallel positioning 82 of the cable 80 may be assisted by the geometry of the cable channel 49 allowing the cable 80 to remain substantially unimpeded when located against the cable channel 49 in a position parallel 82 with the direction of insertion 70 of the cartridge 40.

With continued reference to FIGS. 1-6 and 8, FIG. 7 additionally shows a top front perspective view of an embodiment of connector apparatus 100 with a cable 80 in a perpendicular position 84. The cable cradle 29 (shown in FIG. 2) of the housing 20 may allow a cable, such as cable 80, to bend away from the insertable cartridge member 40 so that a portion of the cable 80 is oriented so that following the bend the portion of the cable 80 is positioned perpendicular 84 to the direction of insertion 70 of the cartridge member 40. Moreover, because the bend of the cable 80 may occur at or near the cable cradle 29, the cable 80 may not protrude, in a direction opposite the direction of insertion 70, beyond the second end 27 of the housing 20, or second end 51 of the cartridge member 40 when it is inserted into the hollow portion 28 of the housing 20.

A method of forming an ethernet connector 100 is described in reference to FIGS. 1-8. The method may comprise providing an insertable cartridge 40 having at least one hole 47 extending vertically from a bottom portion 43 of the cartridge 40 to a top portion 41 of the cartridge 40. A wire 90 may be inserted through the hole. The wire 90 may be a wire from a twisted wire pair, such as wire pair 94. Moreover, the wire 90 may be pulled tight though the hole so that it can not extend further due to physical restraint or impedance provided by the twisted configuration of the twisted wire pair 94. Additionally, by pulling the wire 90 tight through the hole 47 so that a twist of the wire pair 94 is positioned against, or very near the entrance of the hole 47, the ultimate distance between the twisted wire pair 94 and the connection point of the wire 90 with the IDC 60, as accessed through the access feature 45, is, inter alia, minimized. Consequently the described method of forming an ethernet connector 100 may facilitate diminishment of interference or cross-talk between the individual wires 90 in the cable 80. Furthermore, methodology for forming an ethernet connector 10 may include providing a housing 20 having an insulation displacement contact 60 permanently immobilized near a rear portion of a cavity 28 extending into the housing 20. Still further, methodology may include inserting the cartridge 40 into the cavity 28 of the housing 20 so that the wire 90 makes an electrically operable connection with the insulation displacement contact 60. The insertion of the cartridge 40 into the cavity 28 of the housing 20 may be assisted or guided by rails 44 interacting with slots 24 to help properly align the cartridge 40 and direct it to a location wherein the IDC 60 may operably mate with a wire 90 when the cartridge 40 is inserted.

Once the cartridge 40 is inserted, additional ethernet connector 100 forming methodology may include retaining the cartridge 40 in an inserted position by providing engagement features such as shoulders 46 and/or 48 that may snap or lock into place with corresponding detents or ridges in the cavity 28 when the cartridge reaches a proper insertion depth into the extended cavity 28. Moreover, the connector may include forming steps that include providing a cable cradle 29 and/or cable channel 49 that may allow the cable 80 to be respectively oriented in perpendicular 84 and/or parallel 82 alignment in relation to a direction of insertion 70 of the cartridge 40 into the housing 20. Still further, embodiments of a method of forming an ethernet connector may also include providing a groove or other similar features on the cartridge 40 or in the cavity 28 that may accept a wire 90 that is bent over allowing for insertion of the cartridge 40 into the outer housing member 20.

Various modifications and variations of the described apparatus and methods of the invention will be apparent to those skilled in the art without departing from the scope and spirit of the invention. Although the invention has been described in connection with specific embodiments, outlined above, it should be understood that the invention should not be unduly limited to such specific embodiments. Various changes may be made without departing from the spirit and scope of the invention as defined in the following claims.

I claim:

1. A registered jack connector apparatus comprising:

a housing having a first end and a second end, the first end including at least one insulation displacement contact securely located proximate a rear portion of a cavity formed within the housing, wherein the cavity opens at the second end of the housing; and a cartridge member, insertable within the cavity of the housing, wherein the cartridge member includes a first end having at least one hole, said hole configured to receive a wire in a manner so that the wire extends through the hole in a direction perpendicular to an operable direction of insertion of the cartridge into the housing and so that the perpendicularly oriented portion of the wire makes electrical connection with the insulation displacement contact when the cartridge is inserted into the cavity.

2. The registered jack connector apparatus of claim 1, wherein the cartridge member includes a rail member configured to interact with a corresponding slot formed on a side wall of the cavity to help align the cartridge member as it is inserted into the housing.

3. The registered jack connector apparatus of claim 1, wherein the cartridge member includes a recessed groove into which the wire may lay following extension of the wire through the hole.

4. The registered jack connector apparatus of claim 1, wherein the hole is located at an end of the groove.

5. The registered jack connector apparatus of claim 1, further comprising a cable cradle configured to permit a cable including said wire to bend so that a lengthwise portion of the cable is oriented in a direction perpendicular to the direction of insertion of the cartridge.

6. The registered jack connector apparatus of claim 1, wherein the connector is an RJ-45 type connector.

7. An ethernet connector comprising:

a housing having an insulation displacement contact securely disposed within a hollow portion of the housing; and an insertion member, having a hole positioned so that a wire inserted through and extending out of the hole will lay into a recessed groove formed on an exterior surface of the insertion member and wherein the inserted wire makes electrical contact with the insulation displacement contact when the insertion member is compressed into the hollow portion of the housing, such that the portion of the wire that makes electrical contact with the insulation displacement contact is oriented perpendicular to the direction of insertion of the insertion member.

8. The ethernet connector of claim 7, wherein the insertion member includes a cable channel configured to accept a lengthwise portion of a cable when the cable oriented in a direction substantially parallel with a direction of insertion of the insertion member.

9. The ethernet connector of claim 7, wherein the insertion member includes a retention shoulder configured to help retain the insertion member once it is compressed into the hollow portion of the housing.

10. The ethernet connector of claim 7, wherein the insertion member includes a rail member configured to interact with a corresponding slot formed on a side wall of the hollow portion to help align the insertion member as it is inserted into the housing.

11. The ethernet connector of claim 7, wherein the connector is an RJ-45 type connector.

12. The ethernet connector of claim 7, further comprising a cable cradle configured to permit a cable including said wire to bend so that a lengthwise portion of the cable is oriented in a direction perpendicular to the direction of insertion of the insertion member.

13. The ethernet connector of claim 7, wherein the insertion member includes access features through which the IDC electrically contacts the wire.

14. The ethernet connector of claim 7, wherein the housing includes a locking tab.

15. A registered jack connector comprising:

an outer member, having at least two insulation displacement contacts firmly located at the back end of a receiving chamber; and an inner member, insertable with the receiving chamber, wherein the inner member includes means of tightly retaining wires from a twisted wire pair so that the twisted wire pair is located proximate the back end of the receiving chamber when the wires from the twisted wire pair electrically mate with the at least two insulation displacement contacts when the inner member is inserted into the receiving chamber pushing the wires against the insulation displacement contacts located at the back end of the chamber, such that the portions of the wires that electrically mate with the insulation displacement contacts are oriented perpendicularly to the direction of insertion of the inner member.

16. The registered jack connector of claim 15, wherein the connector is an RJ-45 type connector.

17. The registered jack connector of claim 15, wherein the inner member includes recessed grooves into which the wires from the twisted wire pair may lay.

18. A method of forming an ethernet connector, said method comprising:

providing an insertable cartridge having at least one hole extending vertically from a bottom portion of the cartridge to a top portion of the cartridge;

inserting a wire through the hole;

providing a housing having an insulation displacement contact permanently immobilized near a rear portion of a cavity extending into the housing; and inserting the cartridge into the cavity of the housing so that the wire makes an electrically operable connection with the insulation displacement contact in a manner wherein the electrically connected portion of the wire is oriented perpendicular to the direction of insertion of the cartridge into the cavity.

19. The method of forming an ethernet connector of claim 18, further comprising retaining the cartridge in an inserted position by providing retaining shoulders that snap into place in the cavity when the cartridge reaches a proper insertion depth into the cavity.

20. The method of forming an ethernet connector of claim 18, further comprising providing a on the cartridge that accepts a wire that is bent over allowing for insertion of the cartridge into the housing.

* * * * *